US010919671B2

(12) United States Patent
Hanan

(10) Patent No.: US 10,919,671 B2
(45) Date of Patent: Feb. 16, 2021

(54) TAMPER EVIDENCE BRIDGES

(71) Applicant: Niagara Bottling, LLC, Ontario, CA (US)

(72) Inventor: Jay Clarke Hanan, Ontario, CA (US)

(73) Assignee: Niagara Bottling, LLC, Diamond Bar, CA (US)

( * ) Notice: Subject to any disclaimer, the term of this patent is extended or adjusted under 35 U.S.C. 154(b) by 0 days.

(21) Appl. No.: 16/386,100

(22) Filed: Apr. 16, 2019

(65) Prior Publication Data

US 2019/0241325 A1 Aug. 8, 2019

Related U.S. Application Data

(62) Division of application No. 15/423,383, filed on Feb. 2, 2017, now Pat. No. 10,377,534.
(Continued)

(51) Int. Cl.
*B65D 41/34* (2006.01)
*B65D 55/02* (2006.01)
*B65D 1/02* (2006.01)

(52) U.S. Cl.
CPC ..... *B65D 41/3447* (2013.01); *B65D 1/0246* (2013.01); *B65D 1/0284* (2013.01);
(Continued)

(58) Field of Classification Search
CPC ..... B65D 41/3447; B65D 1/0284; B65D 41/3495; B65D 1/0246; B65D 2101/00; B65D 41/3409; B65D 41/3404; B65D 55/024; B65D 2401/20; B65D 88/64; B65D 2588/64; B65D 43/0235; B65D 83/7575; B65D 33/2585; B65D 41/3419; B65D 41/3438; B65D 41/3457; B65D 41/3461; B65D 41/0464; B65D 41/0457; B65D 83/0027
USPC ... 215/40–55, 214, 217, 218, 243, 281, 329, 215/356, 357, 901; 220/288–304, 220/315–328
See application file for complete search history.

(56) References Cited

U.S. PATENT DOCUMENTS 2,947,432 A 8/1960 Marcel
3,335,889 A 8/1967 Brumme
(Continued)

FOREIGN PATENT DOCUMENTS

CN 101234688 8/2008

*Primary Examiner* — Kareen K Thomas
(74) *Attorney, Agent, or Firm* — Michael Best & Friedrich LLP

(57) ABSTRACT

An apparatus and a method are provided for a container cap comprising a plurality of tamper evidence bridges configured to provide evidence that the container cap has been removed from a container by other than a manufacturer of the container. The tamper evidence bridges comprise a small tab of material that extends from a bottom-most edge of the container cap to a neck ring of the container. The tamper evidence bridges are configured to break, or snap, when the container cap is rotated relative to the neck ring. Broken tamper evidence bridges provide readily visible evidence to an end-user of the container that the container cap has been removed by other than the manufacturer of the container. The high visibility of the tamper evidence bridges serves to discourage vendors from attempting to refill and resale of the used containers.

14 Claims, 6 Drawing Sheets

Related U.S. Application Data

(60) Provisional application No. 62/290,434, filed on Feb. 2, 2016.

(52) U.S. Cl.
CPC ..... *B65D 41/3404* (2013.01); *B65D 41/3409* (2013.01); *B65D 41/3495* (2013.01); *B65D 55/024* (2013.01); *B65D 2401/00* (2020.05); *B65D 2401/20* (2020.05)

(56) References Cited

U.S. PATENT DOCUMENTS 3,773,205 A 11/1973 Keller et al.
3,809,365 A 5/1974 Loffler
3,850,328 A 11/1974 Guala
3,901,403 A 8/1975 Menke
4,674,643 A 6/1987 Wilde
4,744,480 A 5/1988 Luch
4,895,265 A 1/1990 Luch
5,009,324 A * 4/1991 Ochs ..... B65D 41/04 215/274
5,103,991 A 4/1992 Collins
5,137,163 A 8/1992 Moore
5,248,050 A 9/1993 Janousch et al.
5,360,126 A 11/1994 Snyder et al.
5,509,552 A * 4/1996 Eguchi ..... B65D 41/62 215/251
5,740,932 A * 4/1998 Battegazzore ..... B65D 41/3404 215/252
5,743,419 A 4/1998 King
5,749,201 A 5/1998 Cochrane
6,382,444 B1 5/2002 Nyman
6,523,710 B1 2/2003 Hidding et al.
8,794,461 B2 * 8/2014 Major ..... B29C 43/18 215/341
2001/0000602 A1 * 5/2001 Luch ..... B65D 41/3404 215/256
2002/0030031 A1 * 3/2002 Druitt ..... B65D 41/3447 215/252
2002/0134747 A1 * 9/2002 Babcock ..... B65D 41/3409 215/252
2008/0073382 A1 * 3/2008 Higgins ..... B65D 41/3428 222/494
2008/0116162 A1 5/2008 Penny
2008/0197102 A1 8/2008 Farrar et al.
2012/0091091 A1 4/2012 Steinberger

* cited by examiner

TAMPER EVIDENCE BRIDGES

PRIORITY

This divisional application claims the benefit of and priority to U.S. patent application filed on Feb. 2, 2017 and assigned application Ser. No. 15/423,383 and U.S. Provisional Application, entitled "Tamper Evidence Bridges," filed on Feb. 2, 2016 and having application Ser. No. 62/290,434.

FIELD

The field of the present disclosure generally relates to plastic bottles and preforms. More particularly, the field of the invention relates to a tamper evidence bridge that provides a visible indication about whether or not a manufacturer installed container cap has been previous removed.

BACKGROUND

Plastic containers have been used as a replacement for glass or metal containers in the packaging of beverages for several decades. The most common plastic used in making beverage containers today is polyethylene terephthalate (PET). Containers made of PET are transparent, thin walled, and have the ability to maintain their shape by withstanding the force exerted on the walls of the container by their contents. PET resins are also reasonably priced and easy to process. PET bottles are generally made by a process that includes the blow-molding of plastic preforms which have been made by injection molding of the PET resin.

Advantages of plastic packaging include lighter weight and decreased breakage as compared to glass, and lower costs overall when taking both production and transportation into account. Although plastic packaging is lighter in weight than glass, there is still great interest in creating the lightest possible plastic packaging so as to maximize the cost savings in both transportation and manufacturing by making and using containers that contain less plastic.

FIG. 1 illustrates a lower perspective view of an exemplary container 100 typically used for storing liquid contents, and particularly carbonated contents. The container 100 comprises a base 104 that extends up to a grip portion 108. In some embodiments, the base 104 may be of the petaloid variety, although other configurations of the base may be incorporated into the container 100, without limitation. The grip portion 108 comprises a generally smooth, cylindrical portion of the container 100 suitable for affixing a label, as well as providing a location for grasping the container. In some embodiments, the grip portion 108 may comprise one or more sidewall ribs that generally may vary in depth, and may swirl or angulate around the grip portion 108. Additional configurations of the grip portion 108 are disclosed in U.S. Patent Application, entitled "Plastic Container with Strapped Base," filed on Jan. 16, 2014, having application Ser. No. 14/157,400, the entirety of which application is incorporated by reference herein.

In the illustrated embodiment, the grip portion 108 transitions into a shoulder 124, which connects to a bell 128. Although the bell 128 illustrated in FIG. 1 is smooth and generally unornamented, in other embodiments the bell may include design features, such as, by way of non-limiting example, a plurality of scallops. The bell 128 connects to a neck 136, which connects to a finish 140. As shown in FIG. 1, the bell 128 comprises a diameter that generally decreases as the bell 128 extends upward from the shoulder 124 to the neck 136 and the finish 140. The finish 140 may be adapted to receive a closure to seal contents in the container 100, such as, by way of non-limiting example, a container cap 164 or a bottle cap. The finish 140 generally defines an opening that leads to an interior of the container 100 for containing a beverage, or other contents. The finish 140 may be of the Carbonated Soft Drink (CSD) variety, or may be configured to receive container caps suitable for sealing noncarbonated contents within the interior of the container 100.

FIG. 2 illustrates an upper perspective view of an exemplary finish 140 that is configured to rotatably engage with the container cap 164 so as to seal contents within the interior of the container 100. The finish 140 comprises a cylindrical body 148 that includes a peripheral portion with a first edge 152 and a second edge 156 disposed at opposite ends. The first edge 152 defines an opening 160 and is configured to receive a plug seal 168, as shown in FIG. 3 within the container cap 164, as disclosed herein. The second edge 156 is configured to receive the neck 136 of the container 100, as shown in FIGS. 1 and 2, such that the opening 160 is in fluid communication with the interior of the container 100 once the finish 140 is installed thereon.

An exterior of the cylindrical body 148 comprises one or more threads 172 that are configured to rotatably engage with one or more threads 176 of the container cap 164. An engagement of the threads 172 of the finish 140 with the threads 176 of the container cap 164 is best shown in FIG. 3. As shown in FIG. 2, a plurality of gaps 174 may be disposed in the threads 172 and positioned uniformly around the perimeter of the cylindrical body 148. Preferably, the gaps 174 of adjacent threads 172 are vertically aligned so as to form channels 178 extending longitudinally along the finish 140. The channels 178 advantageously operate to relieve pressure within the container 100 when the container cap 164 is loosened. As will be appreciated, the channels 178 may provide a direct route for gases escaping the interior of the container 100, rather than the gases being forced to travel around the finish between adjacent threads 172.

In the embodiment illustrated in FIG. 1, the container cap 164 comprises a tamper evidence band 166 that is disposed around the perimeter of the finish 140. The tamper evidence band 166 is attached to the container cap 164 by a multiplicity of thin connections. A neck ring 170, best shown in FIG. 2, generally comprises a rounded upper portion configured to facilitate passing the tamper evidence band 166 over the neck ring 170 during assembly of the cap 164 onto the container 100. A flat lower portion of the neck ring 170 retains the tamper evidence band 166 positioned below the neck ring 170 during loosening of the cap. For example, when an end-user later loosens the contain cap 164, the neck ring 170 retains the tamper evidence band 166 positioned below the neck ring 170, breaking the thin connections between tamper evidence band and the cap 164. The tamper evidence band 166 remains positioned below the neck ring 170 after the container cap 164 is removed from the container 100. Thus, the tamper evidence band 166 and neck ring 170 cooperate to indicate to the end-user that the cap 164 has not been previously loosened after being installed by the manufacturer.

A drawback to conventional tamper evidence bands, such as the band 166, is that it may be difficult for an end-user to directly observe whether or not the container cap 164 has been previously separated from the tamper evidence band 166 and removed from the container. Consequently, the container cap 164 may be separated from the tamper evidence band 166, the container 100 may be refilled, and another container cap may be installed onto the container, giving little visual indication to the end-user that the container 100 has been reused. One solution to this problem has been to make the finish 140 taller so that the second edge 156 is lower, allowing the tamper evidence band 166 to drop once the container cap 164 has been separated from the container 100. Unfortunately, making the finish 140 taller generally adds unwanted weight to the container 100. Moreover, in some instances the tamper evidence band 166 may be removed from the finish 140 and a new container cap 164 may be placed onto the container 100, leaving a consumer with essentially no evidence that the container 100 had been previous opened.

Another drawback to conventional tamper evidence bands 166 is that the container cap 164 generally must be screwed onto the finish 140 by way of a chuck. A solution to this drawback has been to merely push the container cap onto the finish 140, such that the threads 176 snap onto the threads 172 and the tamper evidence band 166 is retained below the neck ring 170. A drawback to pushing the container cap 164 onto the finish 140 is that snapping the threads 172, 176 together typically requires the threads 172, 176 to be short enough to allow internal pressure within the container to push the container cap off the finish. As will be recognized, such an internal pressure may be due to heat, dissolved gas, or even due to a consumer squeezing the bottle.

What is needed, therefore, is a tamper evidence bridge that provides a visible indication about whether or not a manufacturer installed container cap has been previously removed. Further, there is a need for a reduction of turbulence in liquid contents during pushing the container cap onto the finish during manufacturing as well as a design that resists being pushed off the bottle by internal pressure.

SUMMARY

An apparatus and a method are provided for a container cap comprising a plurality of tamper evidence bridges configured to provide evidence that the container cap has been removed from a container by other than a manufacturer of the container. The tamper evidence bridges comprise a small tab of material that extends from a bottom-most edge of the container cap to a neck ring of the container. The tamper evidence bridges are configured to break, or snap, when the container cap is rotated relative to the neck ring. Broken tamper evidence bridges provide readily visible evidence to an end-user of the container that the container cap has been removed by other than the manufacturer of the container. The high visibility of the tamper evidence bridges serves to discourage vendors from attempting to refill and resale of the used containers.

In an exemplary embodiment, a container configured to provide highly visible evidence of having been opened by other than a manufacturer of the container comprises a base extending upward to a sidewall of the container; a shoulder connected between the sidewall and a bell, a diameter of the bell decreasing as the bell extends upward to a neck of the container; a finish connected to the neck and configured to receive a container cap, the finish comprising a neck ring and defining an opening to an interior of the container; and at least one tamper evidence bridge coupled with the container cap and the neck ring, the at least one tamper evidence bridge being configured to break when the container cap is rotated relative to the finish.

In another exemplary embodiment, the at least one tamper evidence bridge comprises a small tab of material that extends from a bottom-most edge of the container cap to a neck ring of the container. In another exemplary embodiment, the at least one tamper evidence bridge is formed by melting and joining a small portion of the container cap and a small portion of the neck ring by way of a laser. In another exemplary embodiment, the at least one tamper evidence bridge is comprised of a material that is capable of visibly breaking when the container cap is turned with respect to the neck ring, as described above. In another exemplary embodiment, the at least one tamper evidence bridge is comprised of a wax indicator dot configured to break during turning of the container cap, thereby providing visible evidence to the end-user that the container has been opened. In another exemplary embodiment, the at least one tamper evidence bridge comprises one or more portions of the container cap that are melted directly into the portion of the finish under the container cap.

In another exemplary embodiment, at least one tamper evidence bridge comprises a tab extending from the container cap to a suitable geometric feature in the perimeter of the neck ring, the tab being laser molded to the geometric feature. In another exemplary embodiment, the at least one tamper evidence bridges comprises a multiplicity of tamper evidence bridges that are uniformly spaced around the perimeter of the container cap. In another exemplary embodiment, the multiplicity of tamper evidence bridges comprises three tamper evidence bridges that are spaced at substantially 120-degree intervals with respect to the container cap.

In another exemplary embodiment, the container cap is comprised of a multiplicity of scales that are uniformly disposed around the circumference of the bottom-most edge of the container cap and are engagedly coupled with a similar multiplicity of ramps extending from the upper-most surface of the neck ring, and wherein a bridge couples an end of each of the multiplicity of scales with the container cap. In another exemplary embodiment, each of the multiplicity of scales is comprised of a small tab of material that extends from the bottom-most edge of the container cap in a counterclockwise direction with respect to the top of the container cap, and wherein each of the multiplicity of ramps is comprised of a raised portion of the material extending from an upper-most surface of the neck ring in a clockwise direction with respect to the top of the container cap. In another exemplary embodiment, the multiplicity of ramps is positioned on the neck ring so as to engage with the multiplicity of scales when the container cap is suitably tightened onto the finish. In another exemplary embodiment, the bridge is configured to break or bend when the container cap is loosened relative to the neck ring, thereby allowing the multiplicity of ramps to bend or break the multiplicity of scales and provide readily visible evidence to that the container cap has been opened.

In another exemplary embodiment, one or more of the tamper evidence bridges are coupled between the finish and one or more thin film areas comprising the container cap, such that the one or more of the tamper evidence bridges tear or remove the one or more thin film areas during loosening of the container cap, and wherein torn or missing of the one or more thin film areas provides directly visible evidence that the container cap has been removed or opened. In another exemplary embodiment, one or more thin film areas comprise regions of the container cap that are relatively much thinner than other regions of the container cap.

In an exemplary embodiment, a method for a container to provide highly visible evidence of having been opened by other than a manufacturer of the container comprises extending a base upward to a sidewall of the container; connecting a shoulder between the sidewall and a bell; decreasing a diameter of the bell as the bell extends upward to a neck of the container; connecting a finish to the neck and configuring the neck to receive a container cap, the finish comprising a neck ring and defining an opening to an interior of the container; and coupling at least one tamper evidence bridge with the container cap and the neck ring, such that the at least one tamper evidence bridge is configured to break when the container cap is rotated relative to the finish.

BRIEF DESCRIPTION OF THE DRAWINGS

The drawings refer to embodiments of the present disclosure in which.

Figure 1:
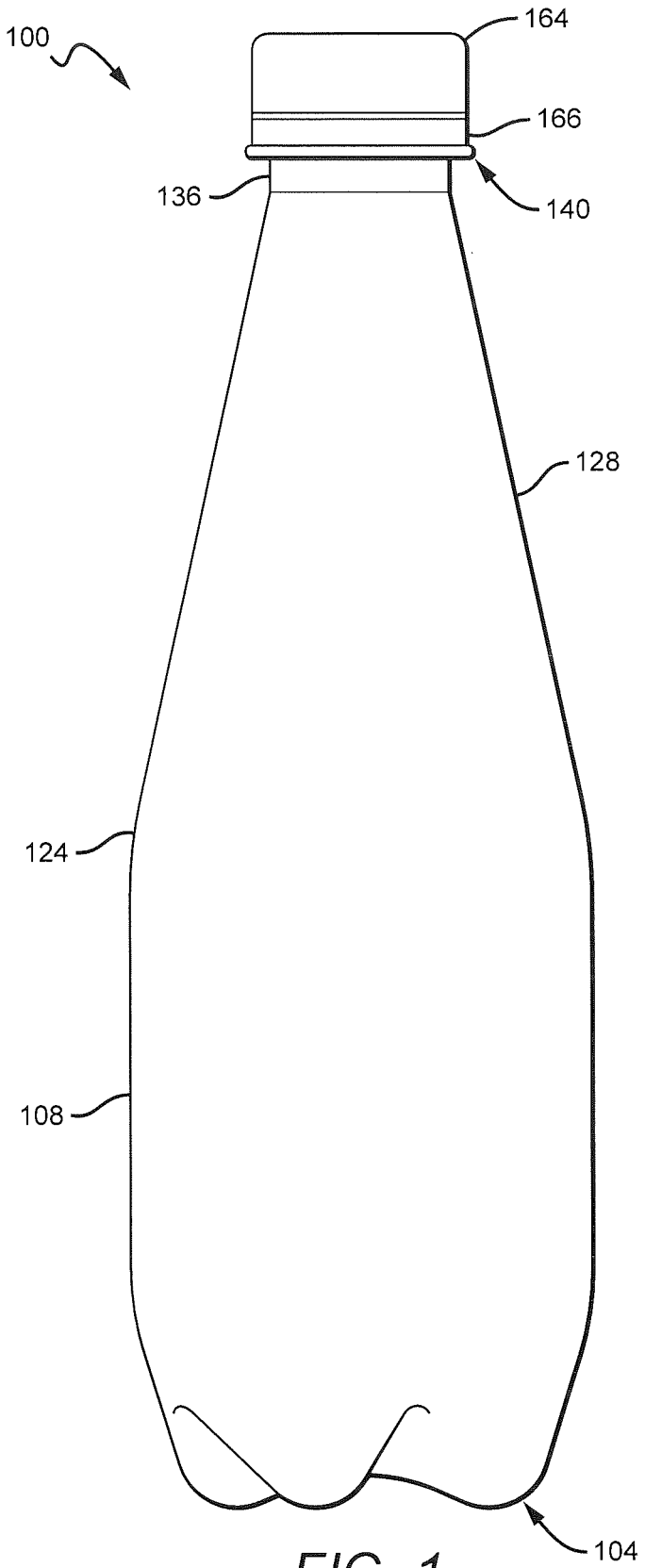
FIG. 1 illustrates a side plan view of an exemplary container suitable for storing pressurized carbonated contents.
Figure 2:
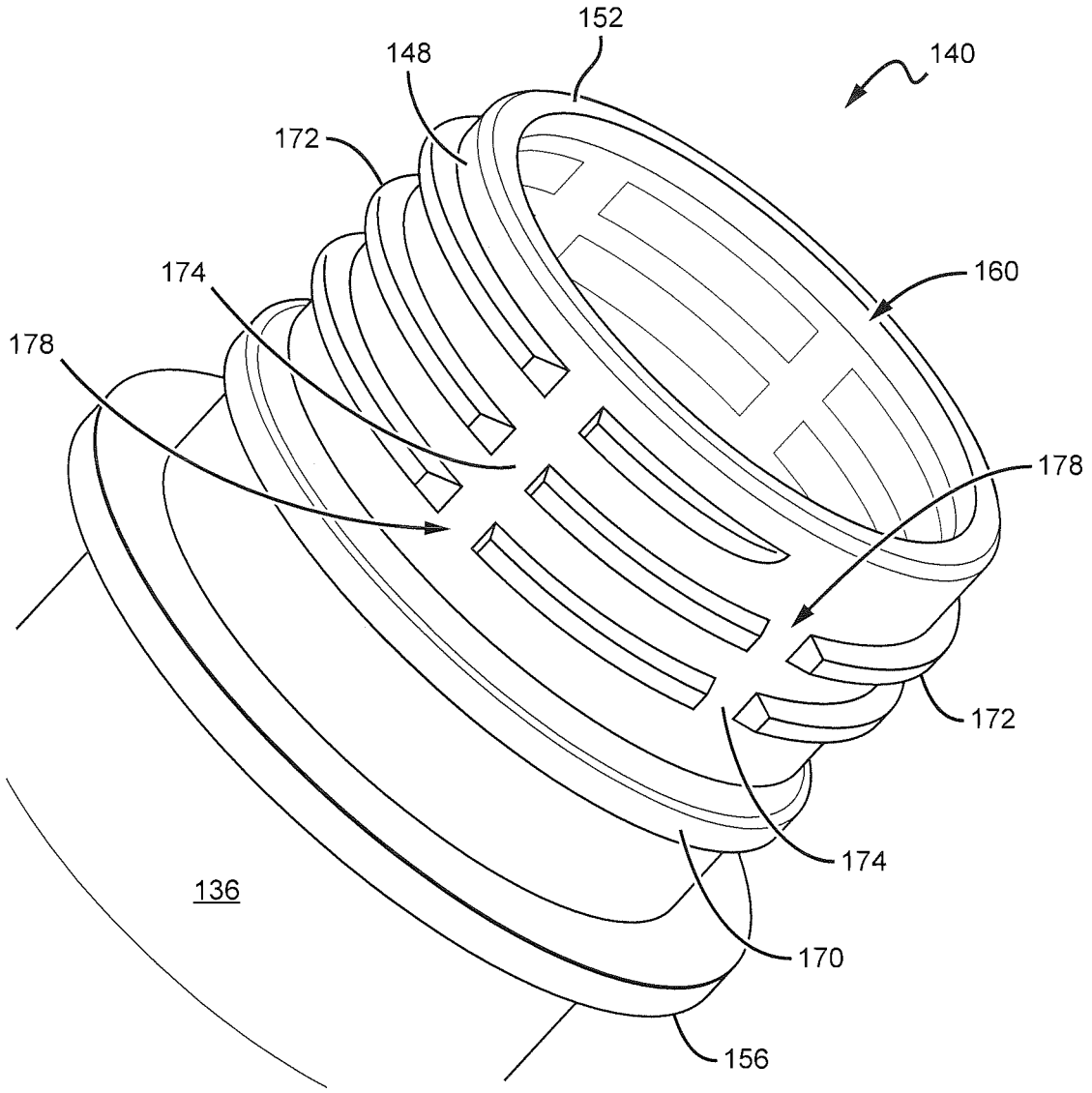
FIG. 2 illustrates an upper perspective view of an exemplary finish.

While the present disclosure is subject to various modifications and alternative foul's, specific embodiments thereof have been shown by way of example in the drawings and will herein be described in detail. The invention should be understood to not be limited to the particular foul's disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first bottle," may be made. However, the specific numeric reference should not be interpreted as a literal sequential order but rather interpreted that the "first bottle" is different than a "second bottle." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure provides an apparatus and method for a container cap comprising a plurality of tamper evidence bridges configured to provide evidence that the container cap has been removed from a container by other than a manufacturer of the container. Each of the tamper evidence bridges comprises a small tab of material that extends from a bottom-most edge of the container cap to a neck ring of the container. The tamper evidence bridges are configured to break, or snap, when the container cap is rotated relative to the neck ring. Broken tamper evidence bridges provide readily visible evidence to an end-user of the container that the container cap has been removed by other than the manufacturer of the container. The high visibility of the tamper evidence bridges serves to discourage vendors from attempting to refill and resale of the used containers.

Figure 3:
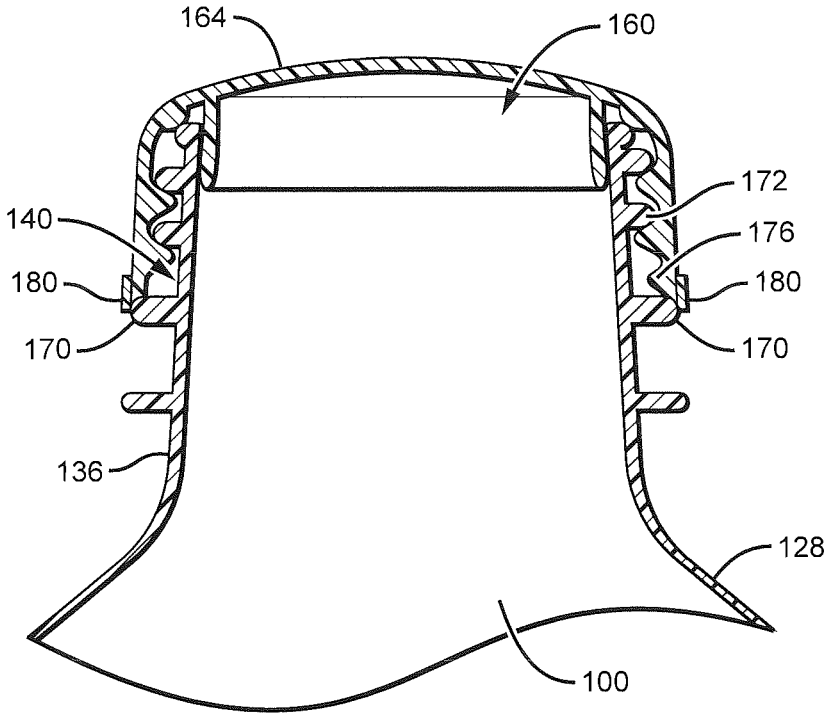
FIG. 3 is a cross-sectional view illustrating an exemplary embodiment of tamper evidence bridges between an exemplary finish and an exemplary container cap, according to the present disclosure.
Figure 4A:
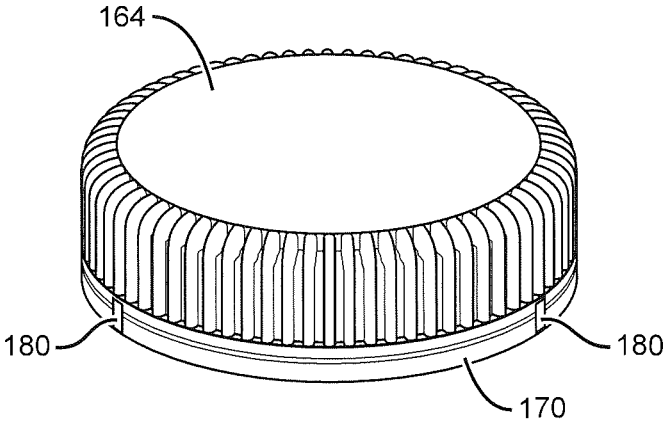
FIG. 4A illustrates a perspective view of an exemplary embodiment of tamper evidence bridges between an exemplary neck ring and an exemplary container cap in accordance with the present disclosure.
Figure 4B:
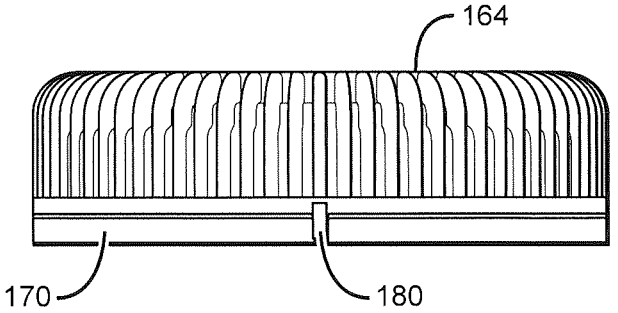
FIG. 4B illustrates a side plan view of the tamper evidence bridges illustrated in FIG. 4A, according to the present disclosure.

FIG. 3 illustrates a cross-sectional view of an exemplary embodiment of a finish 140 with a container cap 164 installed, according to the present disclosure. The container cap 164 illustrated in FIG. 3 is similar to the container cap 164 illustrated in FIG. 1, with the exception that the container cap 164 comprises a plurality of tamper evidence bridges 180 in lieu of the tamper evidence band 166. As best illustrated in FIGS. 4A and 4B, each of the plurality of tamper evidence bridges 180 comprises a small tab of material that generally extends from a bottom-most edge of the container cap 164 to the neck ring 170. The tamper evidence bridges 180 are configured to break, or snap, when the container cap 164 is rotated relative to the neck ring 170. Broken tamper evidence bridges 180 providing readily visible evidence to an end-user of the container 100 that the container cap 164 has been removed by other than the manufacturer of the container 100. As will be appreciated, therefore, the highly visible tamper evidence bridges 180 serve to discourage vendors from attempting to refill and resale of the used containers.

In some embodiments, the tamper evidence bridges 180 may comprise separate components that are bonded onto the container cap 164 and the neck ring 170. In general, any of various methods may be used to bond the tamper evidence bridges 180 to the container cap 164 and the neck ring 170, including, but not necessarily limited to, any of various suitable adhesives or melting the bridges onto adjacent portions of the cap and the neck ring by way of any suitable heat source. In some embodiments, the tamper evidence bridges 180 may be comprised of a material that is substantially similar to the material comprising the container cap 164 or the finish 140.

In some embodiments, the tamper evidence bridges 180 may be comprised of any material that is found to be capable of visibly breaking when the container cap 164 is turned with respect to the neck ring 170, as described above. For example, in the embodiment illustrated in FIGS. 5A-5B, the tamper evidence bridges 180 are comprised of a wax indicator dot. Thus, when the end-user turns the container cap 164, the wax indicator dot breaks, providing visible evidence to the end-user that the container has been opened. In still some embodiments, one or more portions of the container cap 164 may be melted directly into the finish 170 under the container cap in lieu of being bridged to the neck ring 170, as described above. In such embodiments, a hot wire or other suitable tool may be utilized to press the sidewall of the container cap directly against the finish 140. Further, in some embodiments, the neck ring 170 may be omitted from the finish 140 and the container cap 164 may be molded directly to any of various suitable features of the finish 140. As will be appreciated, such embodiments may advantageously reduce the amount of material comprising the finish 140 and the container cap 164.

In the embodiment illustrated in FIGS. 4A-4B, the tamper evidence bridges 180 are formed by melting and joining a small portion of the container cap 164 and a small portion of the neck ring 170 by way of a laser. As will be appreciated, laser melting and joining advantageously reduces the amount of material that must be used to form the finish 140 and the container cap 164. In the embodiment of FIGS. 4A-4B, incorporating the tamper evidence bridges 180 reduces the material comprising the container cap 164 by substantially 0.1 grams, or about 14%, and reduces the material comprising the finish 140 by substantially 18%.

Figure 6A:
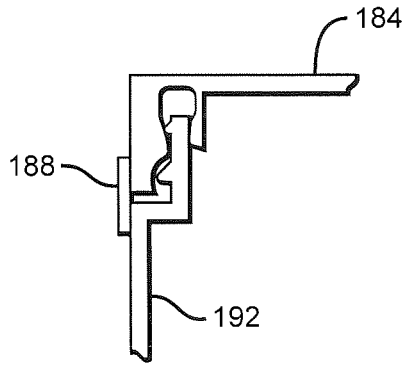
FIG. 6A illustrates a cross-sectional view of an exemplary embodiment of a tamper evidence bridge molded to a container cap and a finish, in accordance with the present disclosure.
Figure 6B:
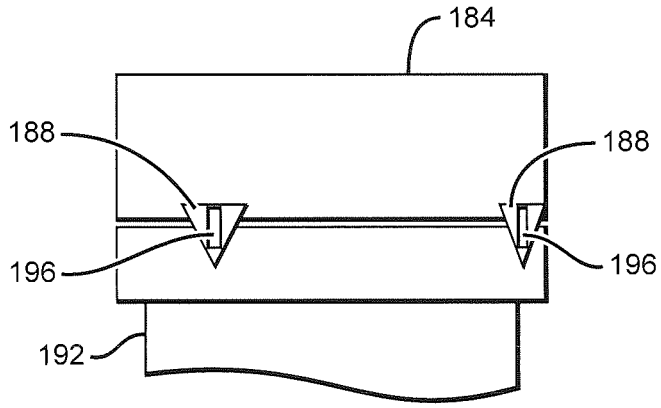
FIG. 6B illustrates a side plan view of the tamper evidence bridge molded to the container cap and the finish as illustrated in FIG. 6A, according to the present disclosure.

In some embodiments, however, a physical tab may be injection molded onto the container cap 164 and then laser melted onto a geometric feature, such as a well, on the neck ring 170. For example, in the embodiment illustrated in FIGS. 6A-6B, a container cap 184 comprises a plurality of tamper evidence bridges 188 that are formed as a portion of the cap by way of injection molding. A finish 192 of the container 100 comprises a plurality of wells 196 disposed around the perimeter of the finish so as to be coincide with the tamper evidence bridges 188 when the container cap 184 is tightly sealed with the finish 192. During manufacturing or bottling, the container 100 may be filled with liquid contents and the container cap 184 tightly installed onto the finish 192, such that the tamper evidence bridges 188 are positioned within the wells 196. Assembly of the tamper evidence bridges 188 may be completed upon laser melting the tamper evidence bridges 188 onto the wells, as shown in FIG. 6B.

With reference again to FIGS. 4A-4B, the plurality of tamper evidence bridges 180 may be evenly spaced around the perimeter of the container cap 164 and the neck ring 170. For example, in the illustrated embodiment, three tamper evidence bridges 180 are spaced at substantially 120-degree intervals with respect to the container cap 164. It should be understood, however, that the number of tamper evidence bridges 180 may be more or less than three, and the intervals between adjacent of the tamper evidence bridges 180 need not be limited to 120-degrees. In some embodiments, for example, four tamper evidence bridges 180 may be disposed at substantially 90-degree intervals around the perimeter of the container cap 164. Further, the tamper evidence bridges 180 need not be limited to uniform spacing around the perimeter of the finish, but rather the tamper evidence bridges 180 may be positioned around of the perimeter with any suitable spacing between adjacent tamper evidence bridges without deviating beyond the spirit and scope of the present disclosure.

Figure 5A:
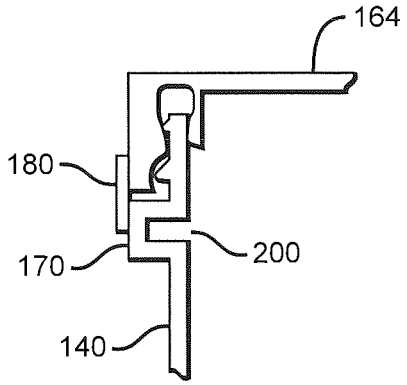
FIG. 5A illustrates a cross-sectional view of an exemplary embodiment of a tamper evidence bridge coupling a container cap and a finish, in accordance with the present disclosure.
Figure 5B:
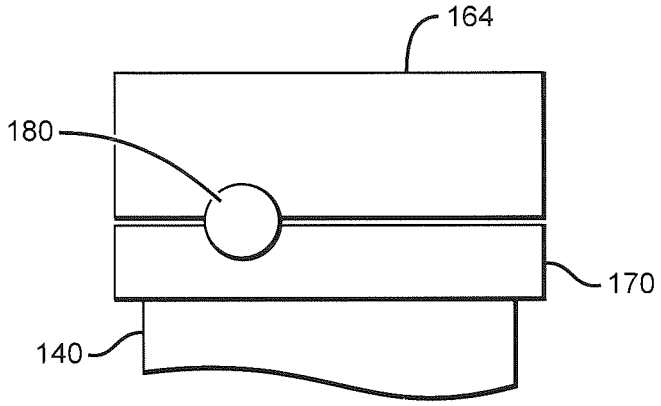
FIG. 5B illustrates a side plan view of the tamper evidence bridge coupling the container cap and the finish as illustrated in FIG. 5A, according to the present disclosure.

Moreover, it should be recognized that incorporating the plurality of tamper evidence bridges 180 into the finish 140 and container cap 164 may substantially improve the efficiency of filling and capping of the container 100 during manufacturing or bottling. As will be recognized, pushing the container cap 164 directly onto the finish 140 is faster and relatively more efficient than using a chuck to screw the container cap 164 onto the finish 140. In absence of a conventional tamper evidence band 166, the container cap 164 may be quickly pushed onto the finish 140 and the tamper evidence bridges 180 welded with relatively greater efficiency. Further, absence of the conventional tamper evidence band 166 facilitates incorporating features within the finish 140 that may operate to reduce turbulence or waves in the liquid contents during filling and capping of the container. In some embodiments, for example, the finish 140 may be configured to include a pocket 200 within an interior of the neck ring 170, as shown in FIG. 5A. Those skilled in the art will appreciate that the pocket 200 may operate to reduce spilling of the liquid contents due to waves and turbulence during filling and capping of the container 100.

Figure 7A:
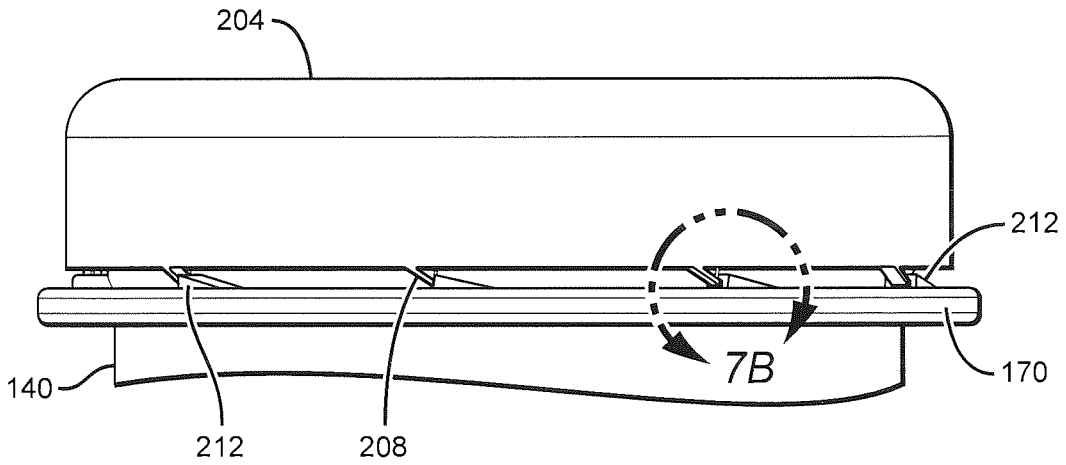
FIG. 7A illustrates a side plan view of an exemplary embodiment of a tamper evidence container cap, in accordance with the present disclosure.

FIG. 7A illustrates a side plan view of an exemplary embodiment of a tamper evidence container cap 204, in accordance with the present disclosure. A multiplicity of scales 208 are uniformly disposed around the circumference of the bottom-most edge of the container cap 204 and engagedly coupled with a similar multiplicity of ramps 212 extending from the upper-most surface of the neck ring 170. In general, an equal number of scales 208 and ramps 212 may be respectively disposed around the circumference of the container cap 204 and the neck ring 170. It is contemplated, however, that any number of scales and ramps 208, 212 may be incorporated into the container cap 204 and the neck ring 170, without limitation, and thus the number of scales and ramps 208, 212 is not to be limited to the number shown in FIG. 7A. Further, the scales and ramps 208, 212 need not be limited to uniform spacing around the circumference of the container cap 204 and the neck ring 170, but rather the scales and ramps may be positioned around the circumference with any suitable spacing between adjacent scales and ramps without deviating beyond the spirit and scope of the present disclosure.

Figure 7B:
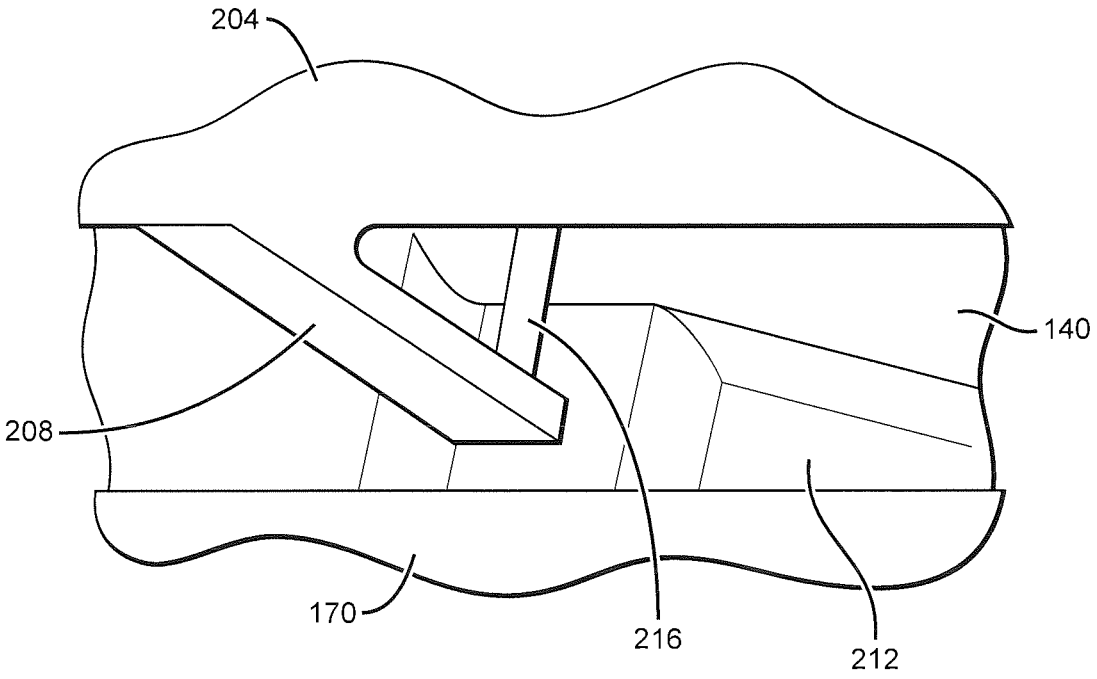
FIG. 7B illustrates a close-up view of a scale and a bridge comprising the tamper evidence container cap illustrated in FIG. 7A.

As best shown in FIG. 7B, each scale 208 is comprised of a small tab of material that extends from the bottom-most edge of the container cap 204 in a counterclockwise direction with respect to the top of the container cap. Further, each ramp 212 is comprised of a raised portion of the material extending from an upper-most surface of the neck ring 170 in a clockwise direction with respect to the top of the container cap 204. Preferably, the ramps 212 are positioned on the neck ring 170 so as to engage with the scales 208, as shown in FIG. 7B, when the container cap 204 is suitably tightened onto the finish 140.

It will be recognized that the scales 208 and the ramps 212 are oriented towards one another, thereby biasing the container cap 204 in favor of being tightened onto the finish 140. In the event an end-user attempts to turn the container cap 204 in the counterclockwise direction, the scales 208 forcibly contact the ramps 212 and resist loosening of the container cap. As shown in FIG. 7B, a bridge 216 couples the end of each scale 208 with the container cap 204. The bridges 216 are configured to break, snap, or bend when the container cap 204 is loosened, or rotated counterclockwise, relative to the neck ring 170. When the bridges 216 break or bend, further loosening of the container cap 204 causes the ramps 212 to bend or break the scales 208 and allow the container cap to be removed from the finish 140. Broken or bent bridges 216 and scales 208 provide readily visible evidence to the end-user that the container cap 204 has been removed by other than the manufacturer of the container 100. As will be appreciated, therefore, the tamper evidence container cap 204 serves to discourage vendors from attempting to refill and resale used containers.

Figure 8A:
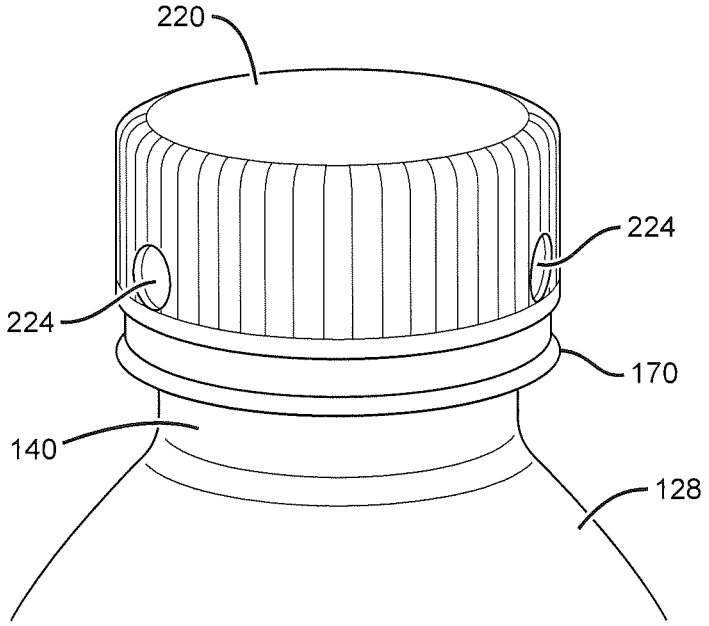
FIG. 8A illustrates a perspective view of an exemplary embodiment of a tamper evidence container cap, according to the present disclosure.

FIG. 8A illustrates a perspective view of an exemplary embodiment of a tamper evidence container cap 220, according to the present disclosure. The tamper evidence container cap 220 is similar to the container cap 164, illustrated in FIG. 1, with the exception that the tamper evidence container cap is comprised of one or more thin film areas 224 disposed on the side of the container cap. The thin film areas 224 generally comprise regions of the container cap 220 that are much thinner than other regions of the container cap. It is contemplated that the thin film areas 224 may be each coupled with a bridge (not shown) or other similar structure that is attached to the finish 140, such that the bridges tear or remove the thin film areas 224 during loosening of the container cap 220. Torn or missing thin film areas 224 provide directly visible evidence to the end-user that the container cap 220 has been removed by other than the manufacturer of the container 100, and thus the tamper evidence container cap 220 serves to discourage refilling and resale used containers by vendors. It will be further appreciated that incorporating one or more thin film areas 224 in the container cap 220 advantageously reduces the reduces the amount of material that must be used to form the container cap 220.

Figure 8B:
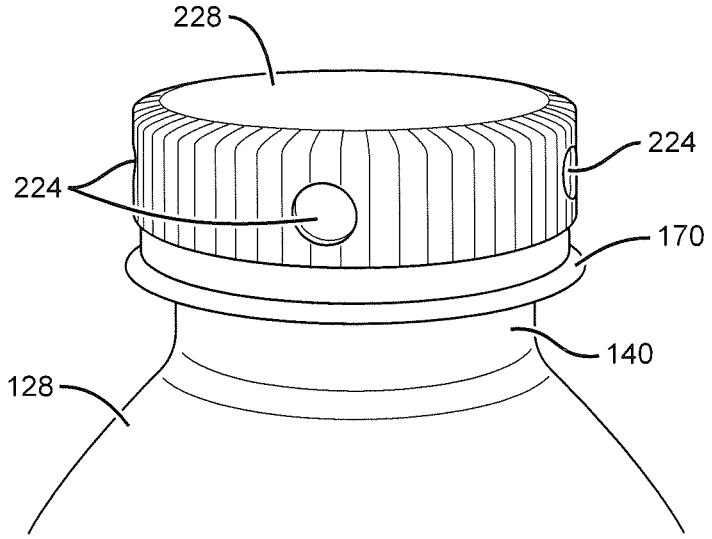
FIG. 8B illustrates a perspective view of an exemplary embodiment of a tamper evidence container cap, in accordance with the present disclosure.

In some embodiments, the thin film areas 224 may be disposed on the container cap 220 so as to be located near the threads 172 of the finish 140, or the thin film areas 224 may be located nearby the bottom-most edge of the container cap 220. Further, any number of thin film areas 224 may be incorporated into the container cap 220 and the neck ring 170, without limitation. For example, the tamper evidence container cap 220 illustrated in FIG. 8A is comprised of three thin film areas 224. Alternatively, FIG. 8B illustrates an exemplary embodiment of a tamper evidence container cap 228 that is comprised of four thin film areas 224. Thus, it should be understood that the number of thin film areas 224 is not to be limited to the numbers shown in FIGS. 8A and 8B. Moreover, the thin film areas 224 need not be limited to uniform spacing around the circumference of the container cap, but rather the thin film areas 224 may be positioned around the circumference with any suitable spacing between adjacent thin film areas 224 without deviating beyond the spirit and scope of the present disclosure.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A container configured to provide highly visible evidence of having been opened by other than a manufacturer of the container, comprising:

a base extending upward to a sidewall of the container;

a shoulder connected between the sidewall and a bell, a diameter of the bell decreasing as the bell extends upward to a neck of the container;

a finish connected to the neck and configured to receive a container cap, the finish comprising a neck ring and defining an opening to an interior of the container; and at least one tamper evidence bridge coupled with the container cap and the neck ring, the at least one tamper evidence bridge configured to break when the container cap is rotated relative to the finish;

the at least one tamper evidence bridge formed as a tab extending from the container cap to a geometric feature in the perimeter of the neck ring, wherein the tab is laser molded to the geometric feature.

2. The container of claim 1, wherein the at least one tamper evidence bridge comprises material that extends from a bottom-most edge of the container cap to a neck ring of the container.

3. The container of claim 1, wherein the at least one tamper evidence bridge is formed by melting and joining a small portion of the container cap and a small portion of the neck ring by way of a laser.

4. The container of claim 1, wherein the at least one tamper evidence bridge is comprised of a material that is capable of visibly breaking when the container cap is turned with respect to the neck ring.

5. The container of claim 1, wherein the at least one tamper evidence bridge is comprised of a wax indicator dot configured to break during turning of the container cap, thereby providing visible evidence to the end-user that the container has been opened.

6. The container of claim 1, wherein the at least one tamper evidence bridge comprises one or more portions of the container cap that are melted directly into the portion of the finish under the container cap.

7. The container of claim 1, wherein the at least one tamper evidence bridges comprises a multiplicity of tamper evidence bridges that are uniformly spaced around the perimeter of the container cap.

8. The container of claim 7, wherein the multiplicity of tamper evidence bridges comprises three tamper evidence bridges that are spaced at 120-degree intervals with respect to the container cap.

9. The container of claim 1, wherein the container cap is comprised of a multiplicity of scales that are uniformly disposed around the circumference of the bottom-most edge of the container cap and are engagedly coupled with a multiplicity of ramps extending from the upper-most surface of the neck ring, and wherein a bridge couples an end of each of the multiplicity of scales with the container cap.

10. The container of claim 9, wherein each of the multiplicity of scales comprises material that extends from the bottom-most edge of the container cap in a counterclockwise direction with respect to the top of the container cap, and wherein each of the multiplicity of ramps is comprised of a raised portion of the material extending from an upper-most surface of the neck ring in a clockwise direction with respect to the top of the container cap.

11. The container of claim 10, wherein the multiplicity of ramps is positioned on the neck ring so as to engage with the multiplicity of scales when the container cap is tightened onto the finish.

12. The container of claim 9, wherein the bridge is configured to break or bend when the container cap is loosened relative to the neck ring, thereby allowing the multiplicity of ramps to bend or break the multiplicity of scales and provide readily visible evidence to that the container cap has been opened.

13. The container of claim 1, wherein one or more of the tamper evidence bridge is coupled between the finish and one or more thin film areas comprising the container cap, such that the one or more of the tamper evidence bridges tear or remove the one or more thin film areas during loosening of the container cap, and wherein torn or missing of the one or more thin film areas provides directly visible evidence that the container cap has been removed opened.

14. The container of claim 13, wherein one or more thin film areas comprise regions of the container cap that are relatively much thinner than other regions of the container cap.

* * * * *